US009402467B2

(12) United States Patent
Baoqing

(10) Patent No.: US 9,402,467 B2
(45) Date of Patent: Aug. 2, 2016

(54) COLLAPSIBLE TABLE AND METHOD OF ADJUSTING THE SAME

(71) Applicant: Zhejiang Hengfeng Top Leisure Co., Ltd., Hangzhou (CN)

(72) Inventor: Yang Baoqing, Hangzhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 13 days.

(21) Appl. No.: 14/639,714

(22) Filed: Mar. 5, 2015

(65) Prior Publication Data

US 2015/0320195 A1 Nov. 12, 2015

Related U.S. Application Data

(60) Provisional application No. 61/989,019, filed on May 6, 2014.

(51) Int. Cl.

| | |
|---|---|
| ***A47B 3/00*** | (2006.01) |
| ***A47B 3/04*** | (2006.01) |
| ***A47B 3/02*** | (2006.01) |
| ***A47B 3/06*** | (2006.01) |

(Continued)

(52) U.S. Cl.

CPC . *A47B 3/04* (2013.01); *A47B 3/002* (2013.01); *A47B 3/02* (2013.01); *A47B 3/06* (2013.01); *A47B 3/12* (2013.01); *A47B 3/10* (2013.01); *A47B 2003/045* (2013.01); *A47C 3/18* (2013.01); *A47C 4/286* (2013.01); *A47C 9/105* (2013.01); *Y10T 29/49819* (2015.01)

(58) Field of Classification Search

CPC ..... A47B 2003/04; A47B 2003/045; A47B 2003/004; A47B 2003/006; A47B 2003/008; A47B 2003/025; A47B 3/04; A47C 9/105; A47C 4/28; A47C 4/286; A47C 4/30; A47C 4/32; A47C 4/34; A47C 4/38; A47C 4/42; A47C 4/44; A47C 4/48; A47C 4/50; A47C 9/00; A47C 3/18; A47C 3/185; F16L 37/0985

See application file for complete search history.

(56) References Cited

U.S. PATENT DOCUMENTS

| | | | | |
|---|---|---|---|---|
| 11,271 A * | 7/1854 | Porter | ..... | A45B 5/00 248/155.3 |
| 82,955 A * | 10/1868 | Ingram | ..... | A47C 9/00 108/128 |

(Continued)

FOREIGN PATENT DOCUMENTS

| | | | |
|---|---|---|---|
| GB | 197413 | A | 5/1923 |
| JP | 2000-354523 | A | 12/2000 |
| KR | 200147235 | Y1 | 6/1999 |

*Primary Examiner* — Daniel J Troy
*Assistant Examiner* — Andres F Gallego
(74) *Attorney, Agent, or Firm* — Thompson Coburn LLP

(57) ABSTRACT

A collapsible table includes upper and lower pole members, a hub, and a tabletop. The upper and lower pole members are pivotally attached to the hub. The upper pole members extend upward and apart from each other from the hub when in their operable configuration and extend downward from the hub and generally parallel to each other when in their stowage configuration. The lower pole members extend downward and apart from each other from the hub when in their operable configuration and extend downward from the hub and generally parallel to each other when in their stowage configuration. The tabletop is removably attachable to the upper pole members and can be suspended by and between the upper pole members when the upper and lower pole members are in their operable configurations.

15 Claims, 4 Drawing Sheets

(51) Int. Cl.

| | |
|---|---|
| ***A47B 3/12*** | (2006.01) |
| *A47C 3/18* | (2006.01) |
| *A47C 4/28* | (2006.01) |
| *A47C 9/10* | (2006.01) |
| *A47B 3/10* | (2006.01) |

(56) References Cited

U.S. PATENT DOCUMENTS

| | | | | | |
|---|---|---|---|---|---|
| 335,823 | A * | 2/1886 | Von Der Linden | A47C 9/105 | 248/165 |
| 405,839 | A * | 6/1889 | Hurlburt | A47C 9/00 | 108/128 |
| 564,129 | A | 7/1896 | Linley | | |
| 1,157,795 | A * | 10/1915 | Mix | A47C 9/00 | 108/128 |
| 1,188,500 | A * | 6/1916 | Simmons | A47C 9/00 | 108/128 |
| 1,717,908 | A * | 6/1929 | Antonuk | A47C 9/105 | 108/128 |
| 2,452,219 | A * | 10/1948 | Bergvall | F16L 37/0985 | 285/317 |
| 3,745,937 | A * | 7/1973 | Gail | A47C 9/105 | 108/128 |
| 5,577,755 | A * | 11/1996 | Metzger | A63C 9/082 | 280/14.24 |
| 6,125,769 | A * | 10/2000 | Tsai | A47C 9/105 | 108/118 |
| 6,520,579 | B2 * | 2/2003 | Kassai | B60N 2/146 | 297/256.12 |
| 6,536,732 | B1 * | 3/2003 | Chang | A47B 3/04 | 108/94 |
| 6,752,091 | B2 * | 6/2004 | Glover | A47B 3/087 | 108/129 |
| 2009/0174233 | A1 * | 7/2009 | Hoffman | A47C 4/286 | 297/16.2 |
| 2013/0049410 | A1 * | 2/2013 | Stafford | A47C 3/18 | 297/16.1 |

* cited by examiner

COLLAPSIBLE TABLE AND METHOD OF ADJUSTING THE SAME

CROSS-REFERENCE TO RELATED APPLICATIONS

This patent application claims the benefit of provisional patent application Ser. No. 61/989,019, which was filed on May 6, 2014.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention pertains to a collapsible table and a method of adjusting the same. More particularly, the present invention pertains to a collapsible table that comprises upper and lower pole members that are attached to a central hub and that can be pivoted down relative to the hub for compact stowage.

2. General Background

Collapsible table and chairs are commonly used in both outdoor settings and indoor settings. Over the past few decades, collapsible chairs of the type that collapse into a relatively compact bundle of poles and fabric have become more popular than standard folding chairs that merely fold flat in one direction, primarily because such chairs are relative easy to carry while walking for prolonged periods of time. In contrast, most collapsible tables are configured into a generally rectangular configuration for stowage, making them difficult to carry while walking for prolonged periods of time.

SUMMARY OF THE INVENTION

The present invention pertains to a collapsible table and a method of adjusting the collapsible table from an operable configuration to a stowage configuration.

In one aspect of the invention, a collapsible table comprises at least three upper pole members, at least three lower pole members, a hub, and a tabletop. The upper pole members are pivotally attached to the hub in a manner such that the upper pole members can be adjusted from an operable configuration to a stowage configuration. The upper pole members extend upward and diverge apart from each other from the hub when the upper pole members are in their operable configuration. The hub prevents the upper pole members from pivoting upward beyond their operable configuration. The upper pole members extend downward from the hub and generally parallel to each other when the upper pole members are in their stowage configuration. The lower pole members are pivotally attached to the hub in a manner such that said lower pole members can be adjusted from an operable configuration to a stowage configuration. The lower pole members extend downward and diverge apart from each other from the hub when the lower pole members are in their operable configuration. The hub prevents the lower pole members from pivoting upward beyond their operable configuration. The lower pole members extend downward from the hub and generally parallel to each other when the lower pole members are in their stowage configuration. The tabletop is removably attachable to the upper pole members and is adapted to be suspended by and between the upper pole members when the upper and lower pole members are in their operable configuration.

Another aspect of the invention pertains to a method of collapsing a table from an operable configuration to a stowage configuration. The table comprises at least three upper pole members, at least three lower pole members, a hub, and a tabletop. The upper and lower pole members are pivotally attached to the hub. The tabletop is suspended by and between the upper pole members. The method comprises detaching the tabletop from the upper pole members and pivoting the upper pole members downward relative to the hub from an operable configuration to a stowage configuration. The upper pole members extend upward and diverge apart from each other from the hub when the upper pole members are in their operable configuration. The upper pole members extend downward from the hub and generally parallel to each other when the upper pole members are in their stowage configuration. The method also comprises pivoting the lower pole members downward relative to the hub from an operable configuration to a stowage configuration. The lower pole members extend downward and diverge apart from each other from the hub when the lower pole members are in their operable configuration. The lower pole members extend downward and generally parallel to each other from the hub when the lower pole members are in their stowage configuration.

Further features and advantages of the present invention, as well as the operation of the invention, are described in detail below with reference to the accompanying drawings.

Figure 1:
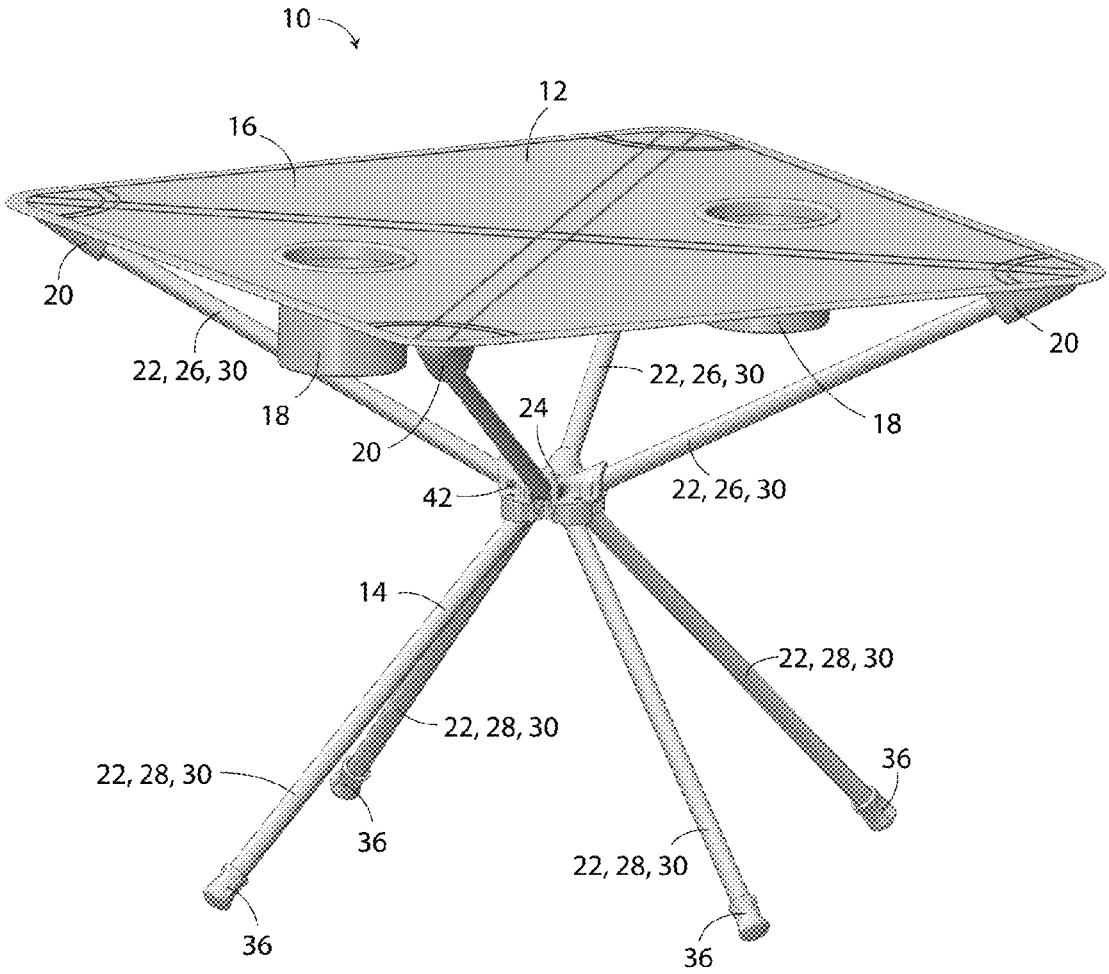
FIG. 1 depicts a perspective view of a collapsible table in accordance with the invention with the table in its operable configuration.

Reference numerals in the written specification and in the drawing figures indicate corresponding items.

DETAILED DESCRIPTION

A preferred embodiment of a collapsible table 10 in accordance with the invention is shown in its entirety in FIG. 1. The collapsible table 10 comprises a tabletop 12 and a frame 14. The tabletop 12 comprises a main portion 16 that is preferably formed of a pliable fabric and that preferably has a polygonal shape. The tabletop 12 preferably also comprises a plurality of cup holders 18 and a plurality of pole pockets 20. Like the main portion 16 of the tabletop 12, the cup holders (18) can be formed of fabric, mesh for example, or can be ridged cup holders inserted into circular holes. The pole pockets 20 are configured to releasably secure the tabletop 12 to the frame 14 of the table 10 and are preferably also formed of a pliable material.

The frame 14 comprises a plurality of pole members 22 and a hub 24. The pole members 22 comprise upper pole members 26 and lower pole members 28. Each of the upper pole members 26 preferably comprises a metal tube portion 30, and a pivot fitting 32 and an end plug fitting 34 at opposite ends thereof. Each of the lower pole members 28 comprises a similar tube portion 30, and a similar pivot fitting 32 and a foot cap 36.

Figure 2:
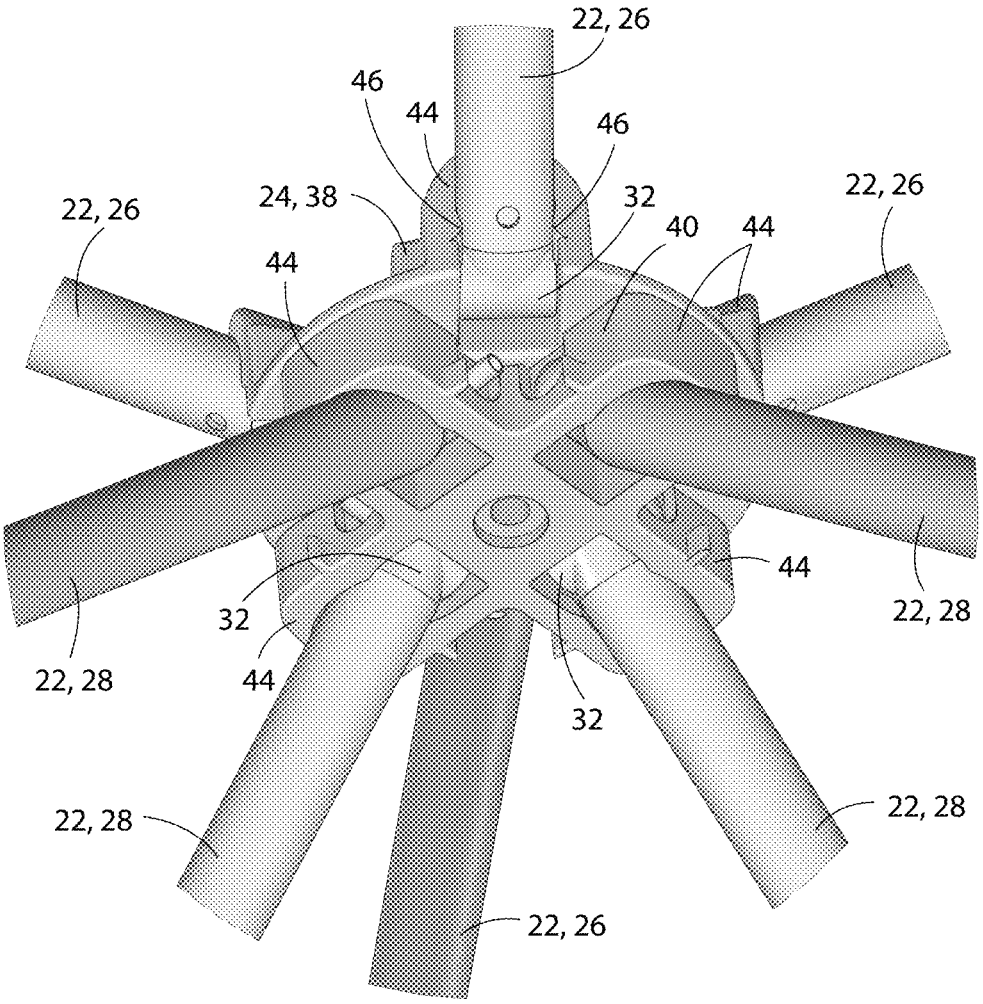
FIG. 2 depicts a detail perspective view of the hub and poles of said collapsible table as seen from below.
Figure 3:
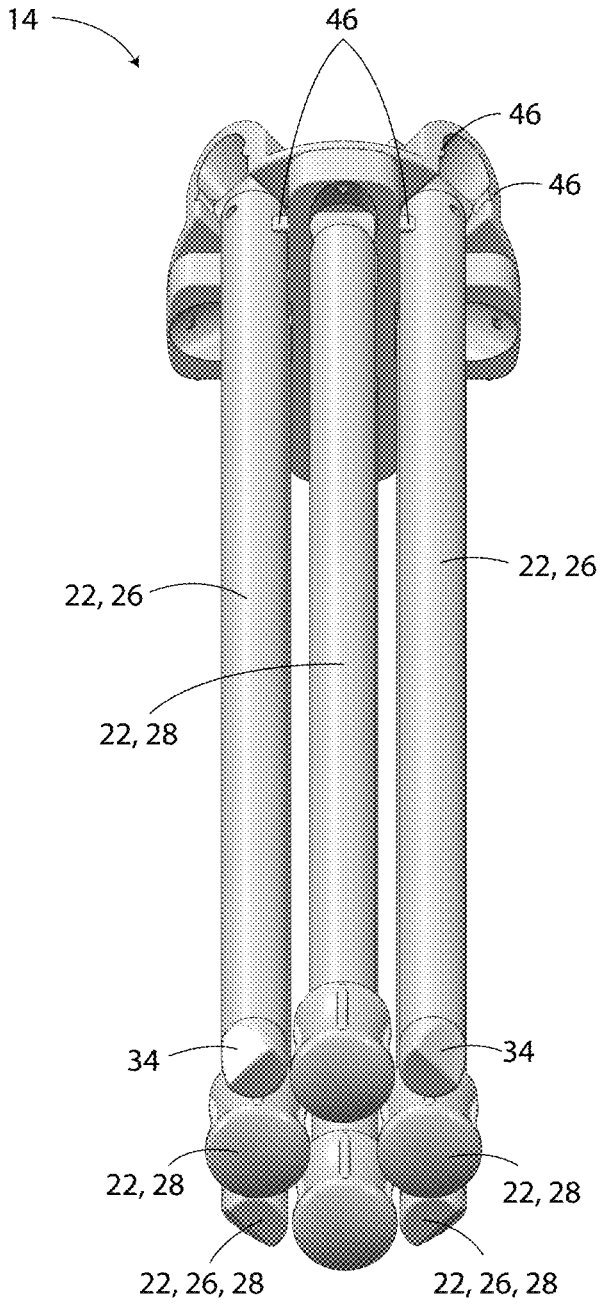
FIG. 3 depicts a perspective view of the frame of said table as seen from below and in its stowage configuration.
Figure 4:
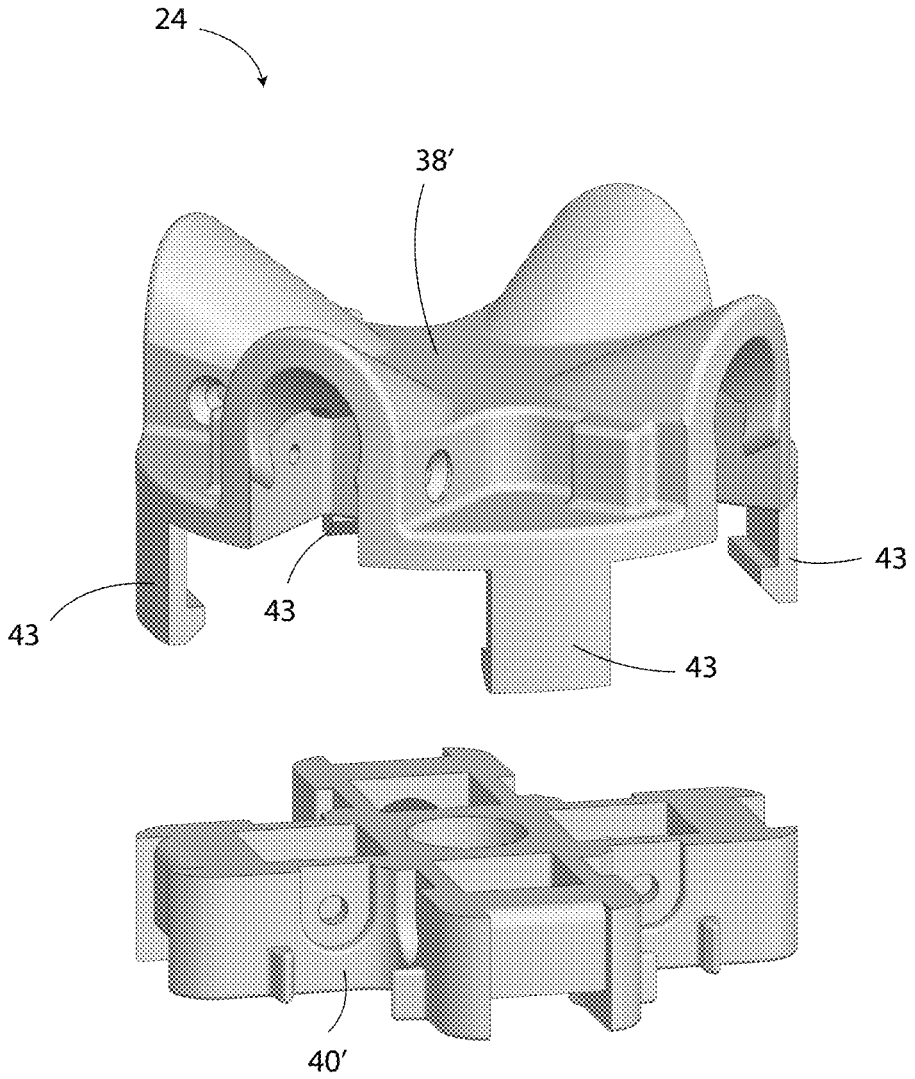
FIG. 4 depicts an exploded view of an alternative embodiment of a hub in accordance with the invention.

The hub 24 is preferably formed primarily by an upper hub piece 38 and a lower hub piece 40 that are fixed to each other via fasteners 42 such as screws or rivets. Alternatively, as shown in FIG. 4, the upper hub piece 38' and the lower hub piece 40' could be configured to snap-lock together via resilient locking tabs 43. Each of the hub pieces 38, 40 preferably comprises a plurality of sockets 44 that define cavities for receiving the pivot fittings 32 of the pole members 22. Each socket 44 preferably comprises a pair of detents 46. The upper pole members 26 are preferably connected to the upper hub piece 38. Likewise, the lower pole members 28 are preferably connected to the lower hub piece 40. A fastener 42 preferably secures the pivot fitting 32 of each of the pole members 22 in the cavity of one of the respective sockets 44. As shown in FIG. 3, each socket 44 is configured to allow the pole members 22 to pivot downward until they are parallel to the center axis of the hub 24 and to each other (their stowage configuration). This allows the frame 14 to be stowed compactly as a small bundle having a dimension not much longer than that of the pole members 22 themselves. The sockets 44 of the upper hub piece 38 are also configured to allow the upper pole members 26 to pivot upward to an extent where the upper pole members extend upward from the hub 24 in a diverging manner, beyond which the sockets prevent further upward pivoting of the upper pole members (their operable configuration). Similarly, the sockets 44 of the lower hub piece 40 are configured to allow the lower pole members 28 to pivot upward, but only to an extent where the lower pole members diverge apart as they extend down from the hub 24 (their operable configuration). Beyond that, the sockets 44 prevent further upward pivoting of the lower pole members 28. The sockets 44 of the upper hub piece 38 are preferably evenly space circumferentially about the hub's 24 central axis. Likewise, the sockets 44 of the lower hub piece 40 are also preferably evenly space circumferentially about the hub's 24 central axis. However, the sockets 44 of the upper hub piece 38 are preferably circumferentially positioned between those of the lower hub piece 40. This prevents the pole members 22 from interfering with each other when in their stowage configuration and thereby allows the pole members to be aligned with each other when in their stowage configuration. As can be seen in FIGS. 2 and 3, each pair of detents 46 protrude toward each other such that the gap between them is slightly less than the diameter of the pole members 22. Thus, in order to adjust the pole members 22 from their operable and stowage configurations, and overcoming torque sufficient to resiliently deflect the detents 46 apart must be applied to the pole members relative to the hub 24. Said detents 46 releasably hold the lower pole members 28 in their stowage configuration. As seen in FIG. 3, the sockets 44 of lower hub piece 40 also preferably also comprise external detents 46 that releasably secure the upper pole members 26 in their stowage configuration.

When the table 10 is in its stowage configuration, the tabletop 12 may be folded and wrapped around the collapsed frame 14. To adjust the table 10 from its stowage configuration to its operable configuration, the frame 14 is set up by adjusting the pole members 22 from their stowage configuration to their operable configuration. With the upper pole members 26 in their operable configuration, the tabletop 12 can be attached to the upper pole members. This is done by inserting the end plug 34 on one of the upper pole members 26 into one of the pole pockets 20 of the tabletop 12, and thereafter inserting the end plug of the upper pole member on the opposite side into the pole pocket on the opposite while stretching the tabletop and/or flexing said upper pole members toward each other. The remaining upper pole members 26 are similarly connected to their corresponding pole pockets. When fully assembled as described, the tabletop 12 is taut and suspended by the upper pole members 26. To adjust the table 10 from its operable configuration to its stowage configuration, the above mentioned steps are merely reversed.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A collapsible table comprising:

at least three upper pole members;

at least three lower pole members;

a hub comprising an upper hub piece and a lower hub piece, the upper hub piece and the lower hub piece being fixed in position relative to each other and secured to each other via a plurality of resilient locking tabs that extend from at least one of the upper and lower hub pieces, each of the upper pole members being pivotally attached to the upper hub piece in a manner such that the upper pole members can be adjusted from an operable configuration to a stowage configuration, the upper pole members extending upward and diverging apart from each other from the hub when the upper pole members are in their operable configuration, the hub preventing the upper pole members from pivoting upward beyond their operable configuration, the upper pole members extending downward from the hub and generally parallel to each other when the upper pole members are in their stowage configuration, the lower pole members being pivotally attached to the lower hub piece in a manner such that the lower pole members can be adjusted from an operable configuration to a stowage configuration, the lower pole members extending downward and diverging apart from each other from the hub when the lower pole members are in their operable configuration, the hub preventing the lower pole members from pivoting upward beyond their operable configuration, the lower pole members extending downward from the hub and generally parallel to each other when the lower pole members are in their stowage configuration;

a tabletop, the tabletop being removably attachable to the upper pole members and being adapted to be suspended by and between the upper pole members when the upper and lower pole members are in their operable configuration.

2. A table in accordance with claim 1 wherein the tabletop is pliable and is stretched taut between the upper pole members when the upper pole members are in their operable configuration.

3. A table in accordance with claim 2 wherein the tabletop is adapted to prevent the upper pole members from pivoting down from their operable configuration when the tabletop is attached to the upper pole members.

4. A table in accordance with claim 1 wherein the hub comprises a plurality of detents that are configured to releaseably secure the upper and lower pole members in their operable configuration.

5. A table in accordance with claim 4 wherein the detents are configured to releaseably secure the upper and lower pole members in their stowage configuration.

6. A table in accordance with claim 1 wherein the hub defines a vertical center axis and the upper and lower pole members are circumferentially spaced about the center axis in a manner such that the upper pole members alternate with the lower pole members circumferentially about the center axis.

7. A table in accordance with claim 1 wherein the table comprises four and only four of the upper pole members and four and only four of the lower pole members.

8. A table in accordance with claim 1 wherein the resilient locking tabs are part of the upper hub piece and extend down therefrom over exterior surfaces of the lower hub piece.

9. A table in accordance with claim 1 wherein the upper hub piece comprises a plurality of detents that are configured to releaseably secure the upper pole members in their operable configuration, and the lower hub piece comprises a plurality of detents that are configured to releaseably secure the upper pole members in their stowage configuration.

10. A method of collapsing a table from an operable configuration to a stowage configuration, the table comprising at least three upper pole members, at least three lower pole members, a hub, and a tabletop, the hub comprising an upper hub piece and a lower hub piece, each of the upper pole members being pivotally attached to the upper hub piece, each of the lower members being pivotally attached to the lower hub piece, the upper hub piece and the lower hub piece being fixed in position relative to each other and secured to each other via a plurality of resilient locking tabs that extend from at least one of the upper and lower hub pieces, the tabletop being suspended by and between the upper pole members, the method comprising:

detaching the tabletop from the upper pole members;

pivoting the upper pole members downward relative to the hub from an operable configuration to a stowage configuration, the upper pole members extending upward and diverging apart from each other from the hub when the upper pole members are in their operable configuration, the upper pole members extending downward from the hub and generally parallel to each other when the upper pole members are in their stowage configuration; and pivoting the lower pole members downward relative to the hub from an operable configuration to a stowage configuration, the lower pole members extending downward and diverging apart from each other from the hub when the lower pole members are in their operable configuration, the lower pole members extending downward and generally parallel to each other from the hub when the lower pole members are in their stowage configuration.

11. A method in accordance with claim 10 wherein the detaching of the tabletop from the upper pole members allows the upper pole members to be pivoted downward.

12. A method in accordance with claim 11 wherein the hub comprises detents that releaseably secure the upper and lower pole members in their operable configurations, and the pivoting of the upper and lower pole members requires overcoming torques sufficient to overcome the detents.

13. A method in accordance with claim 12 wherein the detents automatically releaseably secure the upper and lower pole members in their stowage configurations after the upper and lower pole members have been pivoted.

14. A method in accordance with claim 10 wherein the tabletop is pliable and the detaching of the tabletop from the upper pole members includes at least one of resiliently bending the upper pole members and stretching the tabletop.

15. A method in accordance with claim 10 wherein the resilient locking tabs are part of the upper hub piece and extend down therefrom over exterior surfaces of the lower hub piece.

* * * * *